United States Patent [19]

Gayso

[11] Patent Number: 4,819,341

[45] Date of Patent: Apr. 11, 1989

[54] DRYER FOR PERMANENT PRESS FABRICS

[76] Inventor: Donald Gayso, 1092 Perkins Ter., Memphis, Tenn. 38117

[21] Appl. No.: 920,261

[22] Filed: Oct. 17, 1986

[51] Int. Cl.[4] ..... F26B 19/00

[52] U.S. Cl. ..... 34/86; 34/151

[58] Field of Search ..... 34/86, 90, 91, 133, 34/151

[56] References Cited

U.S. PATENT DOCUMENTS

| | | | |
|---|---|---|---|
| 2,799,948 | 7/1957 | Morrison | 34/90 |
| 3,197,886 | 8/1965 | Brame | 34/90 |
| 3,417,481 | 12/1968 | Rumsey | 34/90 |
| 3,577,650 | 5/1971 | Brahm | 34/151 |
| 3,670,425 | 6/1972 | Benjamin et al. | 34/151 |
| 3,805,561 | 4/1974 | Bullock | 34/151 |
| 3,999,304 | 12/1976 | Doty | 34/90 |
| 4,180,919 | 1/1980 | Baltes | 34/86 |
| 4,304,053 | 12/1981 | Kellerhals et al. | 34/151 |
| 4,516,331 | 5/1985 | Yamauchi et al. | 34/133 |
| 4,684,787 | 8/1987 | Bunting | 34/151 |

FOREIGN PATENT DOCUMENTS 54-108060 8/1979 Japan .

*Primary Examiner*—Henry A. Bennet

*Attorney, Agent, or Firm*—Lorusso & Loud

[57] ABSTRACT

The present invention provides a drying cabinet adapted to be connected to a conventional rotary clothes dryer. The drying cabinet of the invention provides a stationary drying zone for drying permanent press and delicate fabrics without wrinkling. Energy savings are thus obtained by utilization of the waste heat from the conventional domestic clothes dryer. The drying cabinet is a free-standing structure with rigid walls and is provided with a horizontal air distributing plate in its lower interior and a vertical baffle which forces hot air entering through the air distributing plate to pass vertically upward through the interior of the cabinet and then vertically downward through a space defined between the vertical baffle and the rear wall of the cabinet. The hot air inlet and outlet for the cabinet are both provided in the rear wall thereof to facilitate connection to the conventional rotary dryer.

9 Claims, 2 Drawing Sheets

DRYER FOR PERMANENT PRESS FABRICS

FIELD OF THE INVENTION

The present invention relates to a domestic appliance designed as an accessory for a conventional rotary clothes dryer. The drying cabinet accessory of the present invention provides a stationary drying zone for drying permanent press and delicate fabrics.

BACKGROUND OF THE INVENTION

Numerous proposals have been advanced over the years for conserving the waste heat from the conventional domestic clothes dryer. These proposals have included devices for utilizing the waste heat from the clothes dryer to heat the home as well as schemes for routing the waste heat through an auxiliary drying chamber for the drying of certain fabrics. However, problems with space, cost and lint have prevented any significant commercial use of any of the various prior art schemes.

U.S. Pat. No. 3,417,481 issued to Rumsey and U.S. Pat. No. 3,197,886 issued to Brame et al disclose flexible garment bag type devices intended for use as accessories in conjunction with the conventional domestic clothes dryer to provide for the drying of fabrics in a static chamber while hung from hangers so that the clothing can be dried without wrinkling. Thus, these patents address a significant problem arising in connection with the use of a conventional domestic clothes dryer, in that, with the use of a conventional domestic clothes dryer, permanent press fabrics must be removed and hung promptly upon completion of the drying cycle to avoid wrinkles. This requires more time and attention to the job of doing the family laundry. However, the devices disclosed by these patents require space that is unavailable in the typical family laundry area. Further, these prior art devices suffer from inadequate distribution of the drying air through the interior of the garment bag type container and may create a lint problem.

Japanese Kokai No. 54-108060 and U.S. Pat. No. 2,799,948 issued to Morrison also disclose auxiliary drying compartments for domestic clothes dryers which, if utilized, would effect a substantial energy savings and would also provide stationary drying zones for the drying of permanent press and delicate fabrics. However, neither prior art reference discloses apparatus which can e used with a conventional domestic clothes dryer. The appliance disclosed by the Morrison patent has a built-in stationary drying chamber. Aside from the problem of incompatibility with the conventional clothes dryer, the Morrison apparatus is designed so that it would be impossible to filter the drying air at any point intermediate the rotary drying chamber and the stationary drying chamber. Japanese Kokai Publication No. 54-108060 suffers from the same shortcomings as does the Morrison appliance. For example, use of the stationary drying cabinet requires provision of a rotary clothes dryer with a bottom exhaust port which is not provided in conventional domestic appliances.

Accordingly, there exists need to address the dual purpose of waste heat conservation and the drying of permanent press and delicate fabrics in a manner compatible with the space limitations of the typical family laundry area which can be utilized in conjunction with the typical rotary clothes dryer found in most domestic households. No matter how efficient and energy saving an invention might be, it is basically useless if it cannot be successfully commercialized. As noted above, the prior art devices meeting the aforementioned dual objectives are incompatible with domestic space availability and with currently used domestic clothes dryers.

SUMMARY OF THE INVENTION

Accordingly, it is an object of the present invention to provide a domestic appliance with a stationary drying chamber for the drying of permanent press and delicate fabrics.

Another object of the present invention is to conserve energy by utilization of waste heat from the conventional domestic rotary clothes dryer.

Yet another object of the present invention is to achieve the foregoing objectives in an appliance which is practical from the viewpoint of space limitations typically encountered in a domestic laundry room or area.

Yet another object of the present invention is to achieve the foregoing objectives in an apparatus which is fully compatible with the typical conventional domestic rotary clothes dryer.

These and other objects and features of the present invention will become apparent to those skilled in the art from a reading of the ensuing description and claims.

Accordingly, the present invention provides a free-standing cabinet for drying permanent press clothing utilizable as an accessory for a conventional rotary clothes dryer. More specifically, the drying cabinet accessory of the present invention is designed so that it can be placed, i.e. stacked, on top of a conventional rotary clothes dryer or, alternatively, can be suspended above same or located in a side-by-side relationship. The drying cabinet of the present invention has rigid side, rear, bottom and top walls which define a stationary enclosed drying zone. Rods, hooks or other means for suspending clothing freely hanging from hangers are mounted with the enclosure. A door on one side of the cabinet allows access to the interior to the cabinet so that clothes may be placed therein for drying. A hot air inlet port allows for the introduction of hot air received in the form of exhaust air from a conventional rotary dryer and an outlet port allows the hot air to be discharged from the enclosed stationary drying zone, typically through a conduit to a point exterior to the building in which the appliances are located. A conduit is also provided for the purpose of connecting the hot air inlet port with the exhaust outlet of the conventional rotary clothes dryer.

The drying cabinet of the present invention also includes a perforated plate for distributing the introduced hot air evenly throughout the interior of the cabinet, the perforated plate serving to define an air inlet chamber in a space between it and a parallel cabinet wall.

In the preferred embodiments a filter is provided for removing lint from the air entering the stationary drying zone. Optionally, an additional lint filter can be provided at the air outlet of the stationary drying zone.

In the preferred embodiments both the air inlet and the air outlet of the drying cabinet are located in the rear wall of the cabinet (opposite the door). This arrangement facilitates connection to a conventional rotary clothes dryer which also has its air exhaust port located in the rear.

In one preferred embodiment a baffle member is mounted within the stationary drying zone with a gap left between the top of the baffle member and the top wall of the drying cabinet. In this arrangement the baffle forms a false back within the drying cabinet which serves to separate the air inlet chamber or header from the hot air outlet and forces the drying air to pass through the stationary drying zone before exiting.

DETAILED DESCRIPTION OF THE PREFERRED EMBODIMENT

Figure 1:
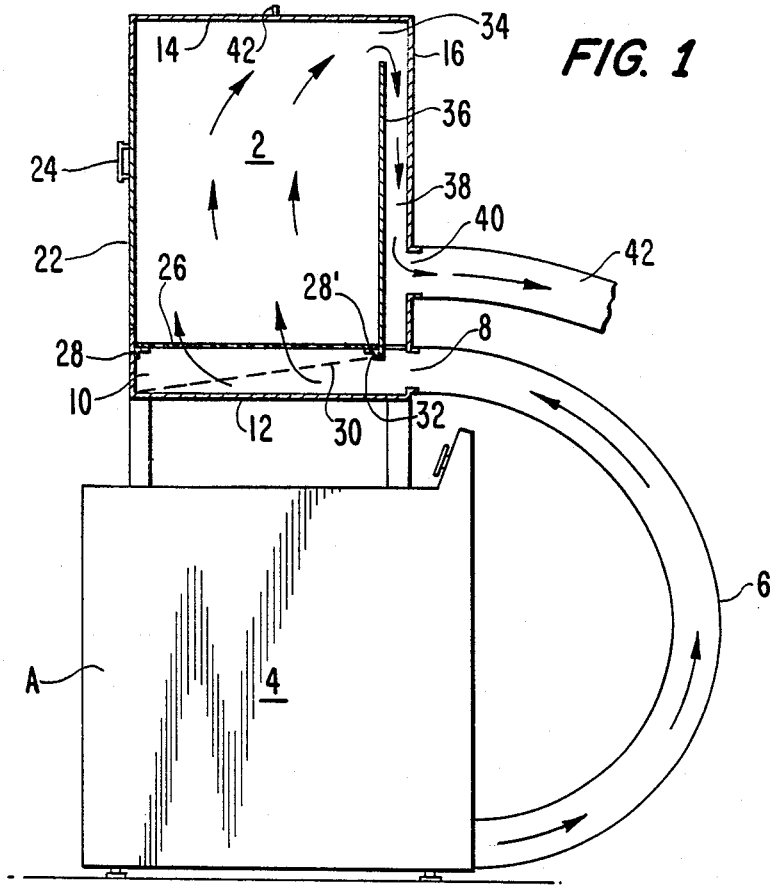
FIG. 1 is a side elevation showing the cabinet of the present invention, in cross-section, stacked on top of a conventional rotary clothes dryer.
Figure 2:
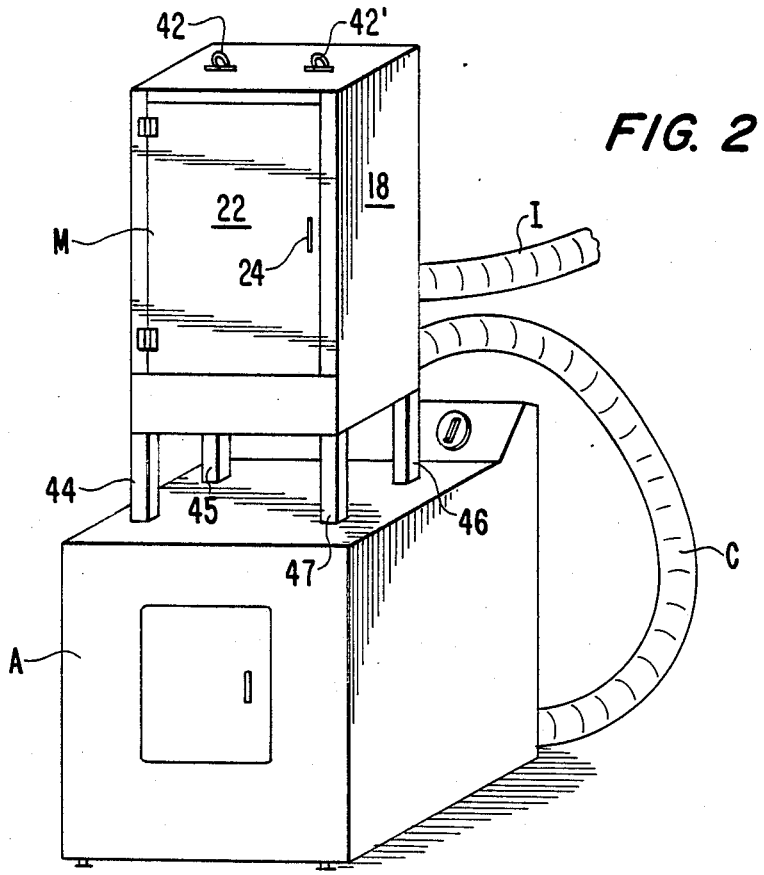
FIG. 2 is a perspective view of the appliances depicted in FIG. 1.
Figure 3:
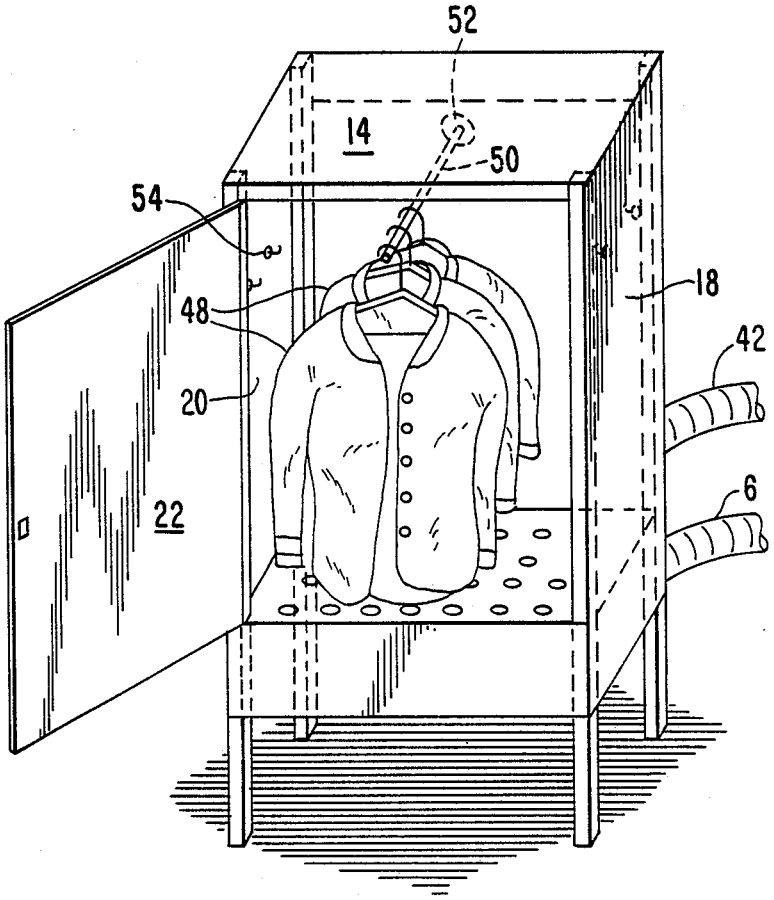
FIG. 3 is a prespective view of the drying cabinet shown in FIG. 1, but open to illustrate the manner of hanging clothes therein.

FIGS. 1–3 illustrate a preferred embodiment of the present invention. FIG. 1 shows the drying cabinet 2 of the present invention stacked on top of a conventional domestic rotary clothes dryer 4. The drying cabinet of the present invention receives hot air exhausted from the conventional rotary clothes dryer 4 through a conduit 6 connected to a hot air inlet port 8. Upon entering the drying cabinet 2 the incoming hot air passes through an air header space 10 defined between the bottom of the cabinet 12 and an air distributing plate 26. The air distributing plate 26 serves to distribute the incoming hot air evenly throughout the interior of the cabinet 2. The air distributing plate 26 merely rests upon a pair of support brackets 28, 28' to allow for easy removal through the door 22, thereby providing access to the air header space 10 and a lint filter element 30 mounted therein. The lint filter screen 30 serves to remove lint from the air entering cabinet 2 and, like the air distributing plate 26, is mounted for easy removal through door 22 to allow for cleaning. The lint filter screen 32 is mounted diagonally across the air header space with its upper end resting on a bracket 32.

The drying cabinet 2 is formed with rigid bottom 12, top 14, rear 16 and side walls 18 and 20 which together define an interior stationary drying chamber. A door 22 and door handle 24 on the front of the cabinet provide access to the interior for hanging and removing clothing articles to be dried.

The air distributing plate 26 may be a screen member but more preferably is a perforated plate.

The hot air, after dispersion through the air dispersing plate 26, travels through the stationary drying zone and through and around the clothing hung therein. The hot air then exits through a gap 34 between the top 14 of the cabinet and a vertical baffle plate 36. The spent hot air then exits through a hot air outlet port 40 and a conduit 42 which directs the hot air for release to the ambient air at a remote point. Thus, the baffle plate 36 serves to force the incoming air to pass through the drying chamber prior to exiting through hot air outlet 40. With this preferred arrangement both the hot air inlet 8 and the hot air outlet 40 are in close proximity at the lower rear of the dryer cabinet to facilitate connection with the conventional dryer which will also typically have its exhaust port in the rear.

One may dispense with the lint filter element 30 when the drying cabinet is used in conjunction with a conventional rotary dryer 4 which has a modern, efficient lint filter built into the appliance.

The dryer cabinet 2 may optionally be provided with a pair of lifting rings, 42, 42' so that the drying cabinet may be suspended from the ceiling if desired.

Although it is not necessary that the drying cabinet be provided with legs, in the embodiment as depicted in the drawing figures and as is best seen in FIG. 2, the drying cabinet may be supported by legs 44, 45, 46 and 47. Depending upon the width of the drying cabinet, it may be necessary that the legs provided be of sufficient height to allow for access to the control panel of the conventional rotary dryer. Toward this end, the legs would be at least 4 inches high and, more preferably on the order of 5 to 6 inches high. However, more preferably, the drying cabinet will be of such a narrow width that it can be positioned to one side or the other of the conventional dryer thereby leaving room for ready access to the controls of the conventional dryer without the necessity of reaching underneath the drying cabinet.

FIG. 3 shows the interior of the drying cabinet 2 containing clothing 48 hung therein. The clothing is hung on the usual clothes hangers from a horizontal bar member 50. The horizontal bar 50 is supported by a bracket 52 fixed to the rear wall 16 of the cabinet. Alternatively, the horizontal bar for receiving the clothes hangers can be arranged parallel to the width of the cabinet extending between brackets provided on side walls 18 and 20. The interior of the cabinet may also be provided with a number of hooks 54 for supporting additional articles of clothing either on hangers or without hangers.

Thus, it will be appreciated that the present invention provides a drying cabinet for permanent press and delicate fabrics which is fully compatible for attachment to the typical domestic laundry dryer. Although the embodiment disclosed herein is preferred, structural variations therefrom are contemplated. Accordingly, the foregoing description is intended to be illustrative and not limiting in connection with the true spirit and scope of the present invention as defined by the appended claims.

I claim:

1. A free-standing drying cabinet for permapress clothing utilizable as an accessory for a conventional rotary clothes dryer used in a domestic laundry room, the conventional rotary clothes dryer having an air inlet and an exhaust outlet, said drying cabinet comprising:

rigid wall means including side, rear, bottom and top walls and defining a cabinet enclosure surrounding an interior stationary drying zone;

a door on one side of said cabinet for providing access to said interior drying zone and for allowing clothing to be placed in said interior drying zone;

means, mounted within said cabinet enclosure, for supporting clothes hangers with clothing thereon in a manner whereby the clothing is allowed to hang freely from the clothes hanger;

a hot air inlet port for introducing hot air into said interior stationary drying zone;

a lint filter adjacent said hot air inlet port;

a hot air outlet port for discharging air from said interior stationary drying zone;

an air distribution plate for distributing the introduced hot air evenly throughout the interior of said cabinet, said air distribution plate being located between said inlet and said interior stationary drying zone; and first conduit means having one end connected to said hot air inlet port and another end adapted to be fixed to the exhaust outlet of the conventional rotary dryer, second conduit means, connected to said hot air outlet port, for exhausting the hot air at a point exterior to the room in which the drying cabinet is located.

2. The dying cabinet of claim 1 wherein said air distribution plate is parallel to and adjacent to said bottom wall to define, in conjunction with said bottom wall, an air header space therebetween.

3. The drying cabinet of claim 2 wherein said hot air inlet port is located in the rear wall of said cabinet enclosure in fluid communication with said air header and said hot air outlet port is located in the rear wall of said cabinet enclosure in fluid communication with said drying zone.

4. The drying cabinet of claim 3 additionally comprising a baffle plate extending vertically from said air distribution plate at the bottom and terminating short of the top wall to define a gap therebetween.

5. The drying cabinet of claim 1 further comprising legs which are at least 4 inches high fixed to said bottom wall to allow access to controls of the conventional dryer.

6. The drying cabinet of claim 5 wherein said legs are spaced to permit said drying cabinet to be stacked on top of a conventional rotary clothes dryer.

7. The drying cabinet of claim 1 additionally comprising brackets for supporting said air distribution plate, said air distributing plate resting on sad brackets in a manner whereby it may be freely lifted to provide access to said air header space.

8. The drying cabinet of claim 7 wherein said lint filter is a screen mounted diagonally across said air header space, said lint filter screen being freely removable for cleaning.

9. The drying cabinet of claim 2 wherein said lint filter is mounted in said air header space.

* * * * *